United States Patent [19]

Yoshimura et al.

[11] 4,314,126

[45] Feb. 2, 1982

[54] MICROWAVE HEATING APPARATUS WITH COOLING CONDUIT

[75] Inventors: Hirofumi Yoshimura, Nara; Junzo Tanaka, Fujiidera; Nobuo Ikeda, Nara, all of Japan

[73] Assignee: Matsushita Electric Industrial Co., Ltd., Kadoma, Japan

[21] Appl. No.: 62,241

[22] Filed: Jul. 30, 1979

Related U.S. Application Data

[63] Continuation-in-part of Ser. No. 47,996, Jun. 13, 1979, abandoned.

[30] Foreign Application Priority Data

Jun. 13, 1978 [JP] Japan ..... 53-71699

[51] Int. Cl.[3] ..... H05B 6/64

[52] U.S. Cl. ..... 219/10.55 R; 219/10.55 B

[58] Field of Search ..... 219/10.55 R, 10.55 F, 219/10.55 D, 10.55 A

[56] References Cited

U.S. PATENT DOCUMENTS 4,097,709 6/1978 Bachtold et al. ..... 219/10.55 R 4,100,463 7/1978 Sugie ..... 219/10.55 R X

*Primary Examiner*—Arthur T. Grimley

*Attorney, Agent, or Firm*—Wenderoth, Lind & Ponack

[57] ABSTRACT

A microwave heating apparatus has a body with a front wall, and a heating chamber within the body for holding an object to be heated. A microwave source is provided for generating microwaves, and a wave guide is connected between the microwave source and a microwave inlet for guiding the microwaves from the microwave source to the heating chamber. A radiant energy heater is disposed within the heating chamber for heating the object to be heated by radiant energy, and a power box is positioned above the chamber and housing the microwave source and the high voltage circuit components therefor. A microwave source cooling fan is provided in the power box, and thermal insulation covers the walls of the heating chamber, the upper surface of the thermal insulation on the top of the chamber and the bottom surface of the power box being spaced to provide a cooling conduit. The front wall of the body has an air suction inlet therein opening into one end of the cooling conduit, and a power box cooling fan is provided at the other end of the cooling conduit. The power box has a suction port therein opening into the cooling conduit upstream of the power box cooling fan for admitting air from the cooling conduit into the power box, the microwave source cooling fan and the power box cooling fan being in parallel flow relation.

2 Claims, 1 Drawing Figure

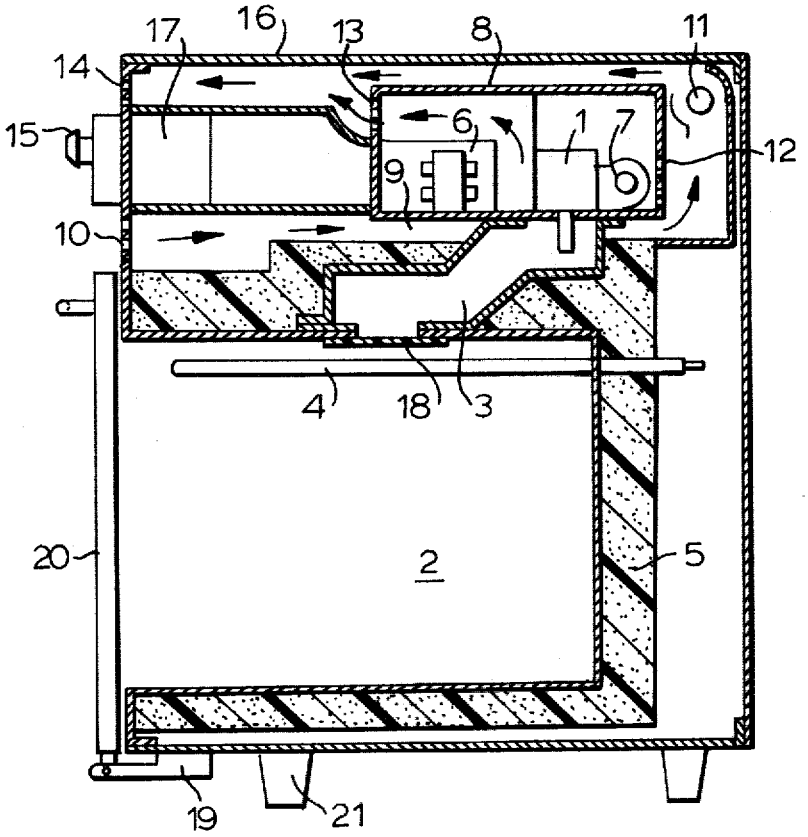
17
16
13
8
11
14
15
6
1
7
12
9
10
4
18
3
20
2
5
19
21

MICROWAVE HEATING APPARATUS WITH COOLING CONDUIT

This application is a continuation of application Ser. No. 47,996 filed June 13, 1979, now abandoned.

This invention relates to a microwave heating apparatus which can carry out dielectric heating by means of a microwave generator in combination with radiant energy heating by a gas or electric heater of equivalent means.

BACKGROUND OF THE INVENTION AND PRIOR ART

In conventional heating apparatus utilizing both dielectric heating and radiant energy heating, the microwave source and control circuit components therefor have generally been disposed beneath the heating chamber so that said source and components will not be exposed to the intense heat of the heating chamber. Particularly, in order that the heating chamber may be selfcleaned, the internal temperature of the chamber must be increased to about 500° C. and this factor has precluded the positioning of the microwave source above the heating chamber. To avoid structural complexity, the control panel also has to be located low on the front wall of the body of the apparatus, so that it is not easy to manipulate.

OBJECT AND BRIEF SUMMARY OF THE INVENTION

The object of this invention is to provide a heating apparatus which has a simple construction and is easy to use. This is accomplished by effectively thermally shielding the microwave source and control circuitry therefor from the heat of the heating chamber and, hence, makes possible the positioning of the microwave source above the heating chamber and the positioning of the control panel on the upper part of the front of the body portion of the apparatus.

This object is achieved by a microwave heating apparatus comprising: a body having a front wall; a heating chamber within said body for holding an object to be heated and having a microwave inlet in the top thereof; a microwave source for generating microwaves and having high voltage circuit components associated therewith; a wave guide connected between said microwave source and said microwave inlet for guiding the microwaves from said microwave source to said heating chamber; a radiant energy heating means disposed within said heating chamber for heating the object to be heated by radiant energy; a power box above said chamber and housing said microwave source and the high voltage components; a microwave source cooling fan in said power box; thermal insulation covering the walls of said heating chamber, the upper surface of said thermal insulation on the top of said chamber and the bottom surface of said power box being spaced to provide a cooling conduit, the front wall of said body having an air suction inlet therein opening into one end of said cooling conduit; and a power box cooling fan at the other end of said cooling conduit, said power box having a suction port therein opening into said cooling conduit upstream of said power box cooling fan for admitting air from said cooling conduit into said power box, said microwave source cooling fan and said power box cooling fan being in parallel flow relation. The apparatus can further have a control panel on the upper portion of the front wall of said body.

The cooling conduit can further extend from the outlet side of said power box cooling fan along the surface of said power box remote from said heating chamber, and said power box can have an outlet therein opening into said cooling conduit downstream of said power box cooling fan.

BRIEF DESCRIPTION OF THE DRAWINGS

This invention will be described in further detail by way of an embodiment wherein the principle of the invention is applied to a microwave oven for home use, reference being made to the accompanying drawing which is a cross-sectional view of the microwave heating apparatus according to this invention.

DETAILED DESCRIPTION OF THE INVENTION

A microwave generator 1 such as a magnetron is disposed above a heating chamber 2 and the microwaves generated by said microwave generator 1 are conducted to said heating chamber 2 through a wave guide 3 formed in the shape of the letter "Z", said wave guide connecting said microwave generator 1 to the microwave inlet in the top of said heating chamber 2. In the heating chamber 2, the microwaves then dielectrically heat an object to be heated which can be an article of food (not shown) placed therein. Also disposed within said heating chamber 2 is a heating means 4 for heating the object by radiant energy heating, e.g. electrically or otherwise. There is also provided thermal insulation 5 which surrounds the exterior walls of said heating chamber 2. Said microwave generator 1 is housed in a power box 8, together with high-voltage circuit components 6 therefor and a fan 7 for cooling said microwave generator. A cooling conduit 9 is defined by and between the bottom wall of said power box 8 and the top wall of said heat insulation 5, with one end of said cooling conduit 9 communicating with an air suction port 10 formed in the front wall of the body of the apparatus while the other end of said conduit 9 communicates with a cooling fan 11 which is independent of the fan 7. An air suction port 12 is formed in the wall of said power box which is adjacent said fan 7 for cooling said microwave generator 1, and opens into said cooling conduit 9 immediately upstream of the cooling fan 11. The cooling fan 11 is adapted to cause air to flow over the exterior wall of the power box 8 and, as does said cooling fan 7 for the microwave generator, draws air from said cooling conduit 9. Thus, the fan 7 for cooling the microwave generator and the cooling fan 11 are disposed in parallel flow relation. This means that the air entering the cooling conduit 9 is subject to a large suction force. The air drawn into the power box 8 by the cooling fan 7 is exhausted through an exhaust port 13 located at the other end of the box 8 from the suction port 12 and merges with the air circulated over the exterior wall of the power box 8 by cooling fan 11. The combined flow of air is exhausted through an exhaust port 14 located in the front wall of the apparatus body into the atmosphere.

Located in an upper front position on the body is a control panel 15, behind which are disposed control circuit components 17. Because these control circuit components 17 have cooling air circulated by said two cooling fans 7 and 11 flowing over both the lower and upper sides thereof, they are also cooled by the cooling air. A seal plate 18 made of a material having small dielectric losses is mounted on the top wall of said heating chamber 2 over the microwave inlet where said wave guide 3 is connected to the chamber so that the heat within the heating chamber will not be transmitted to the microwave generator 1 through the wave guide. Across a front opening of the heating chamber 2 is a door 20 swingable attached to the chamber by hinges 19 secured to a housing 16 in such a manner that said door can be selectively opened and closed to allow the object to be heated to be loaded into the heating chamber 2 or taken out thereof. The housing 16 is provided, externally at its bottom, with supporting legs 21.

The apparatus according to this invention has the following features. Because the flow resistance to the air drawn by the cooling fan 11 located externally of the power box 8 is lower than the flow resistance to the air drawn by the generator-cooling fan 7, the flow rate in the cooling conduit 9 is increased. Moreover, because the two cooling fans 7 and 11 operate in parallel flow relationship, the cooling effect is improved and the intense heat generated by heating means 4 within the heating chamber 2 is prevented from being transmitted to the power box 8 which houses the microwave generator 1 and to the control circuit components 17. Therefore, no objectionable effects are produced even if the radiant energy and microwave heating facilities are utilized concurrently.

Thus, the microwave heating apparatus according to this invention accomplishes the following desirable results: (1) Because the heat of the heating chamber is not easily transmitted to the microwave generator, the microwave generator can be installed above the heating chamber and, accordingly, the control panel can be positioned on an upper front part of the apparatus. These features result in a simplified construction and a greater ease of operation; (2) The apparatus is able to fully withstand the heat developed when microwave heating and radiant energy heating are concurrently utilized; (3) The microwave generator and semiconductive circuit components are not thermally affected even if the heating chamber is self-cleaned by increasing its internal temperature to about 500° C.; (4) Because the microwave generator and high-voltage control circuit components are encased in the power box, the assembling operation is facilitated.

What is claimed is:

1. A microwave heating apparatus comprising:

a body having a front wall and a top wall;

a heating chamber within said body for holding an object to be heated and having a microwave inlet in the top thereof;

a microwave source for generating microwaves and having high voltage circuit components associated therewith;

a wave guide connected between said microwave source and said microwave inlet for guiding the microwaves from said microwave source to said heating chamber;

a radiant energy heating means disposed within said heating chamber for heating the object to be heated by radiant energy;

a power box above said chamber and housing said microwave source and the high voltage circuit components, the top surface of said power box being spaced from said top wall to define a top cooling conduit along the top of said power box;

a microwave source cooling fan in said power box;

thermal insulation covering the walls of said heating chamber, the upper surface of said thermal insulation on the top of said chamber and the bottom surface of said power box being spaced to provide a bottom cooling conduit along the bottom of said power box, the front wall of said body having an air suction inlet therein opening only into one end of said bottom cooling conduit; and a power box cooling fan at the other end of said bottom cooling conduit and discharging into said top cooling conduit, said top cooling conduit having a discharge opening at the end remote from said power box cooling fan, said power box having a suction port therein at the other end of said bottom cooling conduit and opening into said cooling conduit upstream of said power box cooling fan for admitting air from said cooling conduit into said power box, and said power box having a discharge port at the end remote from said suction port communicating with said top cooling conduit, said microwave source cooling fan and said power box cooling fan being in parallel flow relation.

2. A microwave heating apparatus as claimed in claim 1 further comprising a control panel on the upper portion of the front wall of said body.

* * * * *